United States Patent [19]

Dapp et al.

[11] 4,238,549

[45] Dec. 9, 1980

[54] TRANSFER ELEMENTS

[75] Inventors: George P. Dapp; Michael A. Scott, both of Huntington, N.Y.

[73] Assignee: Columbia Ribbon and Carbon Mfg. Co., Inc., Plainview, N.Y.

[21] Appl. No.: 963,856

[22] Filed: Nov. 27, 1978

[51] Int. Cl.[3] ..... B41M 5/10

[52] U.S. Cl. ..... 428/484; 106/31; 427/54.1; 427/153; 428/323; 428/488; 428/913; 428/914

[58] Field of Search ..... 106/22, 27, 28, 31; 427/146, 153, 54.1; 428/484, 488, 913, 914, 323, 207; 430/262, 263

[56] References Cited

U.S. PATENT DOCUMENTS

| | | | |
|---|---|---|---|
| 2,777,781 | 1/1957 | Kordig et al. | 428/488 |
| 2,822,288 | 2/1958 | Harvey et al. | 428/488 |
| 3,036,924 | 5/1962 | Newman | 106/31 X |
| 3,079,351 | 2/1963 | Staneslow et al. | 428/914 X |
| 3,446,646 | 5/1969 | Terry | 428/488 X |
| 3,449,149 | 6/1969 | Toussaint | 428/488 |
| 3,639,166 | 2/1972 | Fellows et al. | 428/327 |
| 3,684,549 | 8/1972 | Shank | 428/476 |
| 4,063,754 | 12/1977 | Shackle et al. | 282/27.5 |

*Primary Examiner*—Bruce H. Hess
*Attorney, Agent, or Firm*—Thomas L. Tully

[57] ABSTRACT

Pressure-sensitive transfer elements having a plastic film foundation carrying a frangible, complete-release pressure-transfer layer applied by means of a volatile coating vehicle and comprising a solid solution of a fluorescing dye in the resinous binder material of said layer. Such transfer elements are adapted to transfer solid images to the surface of a copy sheet, which images fluoresce under exposure to ultraviolet light and are automatically detectible when sensed on the imaged surface of the copy sheet but are not detectible when sensed through the obverse side of the copy sheet.

6 Claims, No Drawings

TRANSFER ELEMENTS

BACKGROUND OF THE INVENTION

The use of fluorescent liquid inks is well-known for the application of information to various types of documents which are intended to be processed or read by means of detection machines. Such inks are widely used for the application or cancellation of postage amounts on mail and for the indication of route codes which enable pieces of mail to be sorted and routed automatically by processing machines. Such inks are also used, alone or in combination with ordinary pigments such as carbon black, to provide images which are clearly visible to the eye and are also machine-readable to provide a double-check system which reduces the ease of fraudulently-altering checks, stock certificates, bonds and other negotiable instruments.

The conventional fluorescent inks are liquid inks which are applied to the intended documents by means of fabric printing ribbons, ink pads or postage meter pads. In many cases, different images are applied to opposite sides of the same document to provide different information on each of said sides. The ink contains an oily vehicle and a fluorescing dye which is soluble in such oil or which is present as a solid solution in a finely-particulate resinous binder material which is dispersed in the oily vehicle in the same manner as a dispersed pigment such as carbon black.

Different fluorescing dyes have different colors and emit different wave-length radiation when exposed to and excited by ultra-violet radiation. The processing machines must be adapted to recognize wave-length emissions over a relatively broad wavelength range and, therefore, must be very sensitive to the detection of even small amounts of fluorescing dyes which emit radiation over any part of the detectible wave-length range. This requirement is also necessitated by the fact that some detectible images are relatively poor in quality or are absorbed and broadened when applied to porous papers or are masked to some extent by the presence of non-fluorescing pigments such as carbon black. If the images cannot be read by the processing machine, the document is rejected and must be processed manually. In some cases, the imperfect images will be misread by the processing machine, causing errors. These defects frustrate the entire purpose of the system.

One of the most common causes of defective results in the system arises from the fact that the fluorescent inks are liquid inks which must be absorbed by the document in order to remain thereon in the form of an image which resists smudging and smearing during contact with the hands or with the processing equipment. While the images are applied as sharp, clear images, such sharpness and clarity is reduced to some extent by the absorption of the liquid ink into the document paper which causes the liquid ink to diffuse and causes the outline of the images to become uneven and fuzzy. Moreover, when different liquid ink images are applied to opposite sides of the same document, the images tend to penetrate sufficiently that they are detected by the processing equipment as objectionable or defective images when read through the opposite side, causing the document to be rejected or misread.

SUMMARY OF THE INVENTION

The present invention relates to novel transfer elements having a plastic film foundation supporting a frangible, complete-release transfer layer of a solid, non-penetrating, volatile vehicle-applied composition comprising a synthetic thermoplastic resinous binder material containing at least one dissolved fluorescing dyestuff, a hard wax which is at least partially dispersed and may also be partially dissolved in said volatile vehicle and at least one liquid oily material which is a compatible plasticizer or softener for said wax, is incompatible with said resin and is a solvent for said dyestuff and does not inhibit the fluorescence thereof. The solubility of the dye in the wax plasticizer and the compatibility of the latter with the wax enables the dye to be carried into the wax as a solid solution.

The present transfer elements provide solid, pressure-transferable compositions which have good affinity for copy sheets and do not penetrate substantially within even porous paper copy sheets. The present compositions contain fluorescing dyes in the form of solid solutions, in which form the dyes have the greatest ability to emit strong radiation under exposure to ultraviolet radiation. The present compositions are also substantially free of ingredients which inhibit or mask the radiation emitted by the excited dyestuffs.

Since the images produced by the present transfer elements should be as sharp and dense as possible, the transfer elements have a smooth film foundation such as polyethylene, polypropylene, polyethylene terephthalate or other thin film which has the ability to sharply and completely release the transfer composition in a stencilling manner under the effects of imaging pressure.

The present compositions are applied to the film foundation as liquid coating compositions comprising a major amount by weight of a volatile solvent such as methyl ethyl ketone, ethyl acetate, toluene and/or other solvents depending upon the specific other ingredients of the composition, a film-forming resinous binder material which is soluble in said solvent and which is a solvent for the particular fluorescing dyes used therewith, one or more fluorescing dyes which are soluble in both said solvent and in said resinous binder material, a wax which is substantially insoluble but preferably partially soluble in said solvent so as to provide, on drying and solidification of said composition, substantially discontinuous wax particles preferably associated with a continuous wax phase, and a non-volatile oil plasticizer for said wax which is compatible with said wax and is a solvent for said dye so as to form a solid solution of said dye in said wax.

Suitable film-forming binder materials will vary to some extent depending upon the specific fluorescing dyes used therewith. However, the generally suitable resin binder materials include vinyl chloride-vinyl acetate copolymers such as Vinylite VYHH, acrylic polymers such as Elvacite (copolymer of methyl methacrylate and ethyl acrylate), linear polyesters such as Vitel (terephthalic acid-aliphatic acid copolyester), and similar resins which are solvents for the dyes, soluble in the coating solvent and which do not mask or unduly impede the fluorescence of the dyes.

Preferred waxes for use in the present compositions are the hard waxes which can be pulverized to the form of fine particulate powders which can readily be mixed with the plasticizer and melted to form the plasticized wax. The required adhesion of the coating to the film foundation and the required stencilling or complete transfer properties of the coating are improved in cases where the wax is present in both dissolved and dispersed form. Preferably, the wax is present in at least about 80% by weight particulate form and at least about 20% by weight continuous form in the final transfer layer but these percentages are difficult to establish since it appears that some of the dissolved wax precipitates during drying of the coated composition. A preferred wax is carnauba wax but other waxes such as ouricury wax, microcrystalline wax, candelilla wax, montan wax and the like can also be used with the proper selection of coating solvent and compatible softener or plasticizer. Soft waxes such as beeswax, petroleum wax and the like are unsuitable.

The selection of the appropriate softener or plasticizer oil will depend upon the particular wax used. In all cases, the plasticizer must be non-volatile, compatible with the wax and a solvent for the fluorescing dye. A preferred plasticizer for use with carnauba wax is a sorbitan ester sich as sorbitan monolaurate. In general, the petroleum oils are unsatisfactory since they are not solvents for the conventional fluorescing pigments. Esters, such as butyl stearate and dioctyl phthalate, vegetable oils, animal oils and related non-volatile oily materials, may be selected depending upon their solvent properties for the dye and their compatibility with the wax.

The fluorescing dyes useful according to the present invention are those which are capable of emitting intense radiation within the range of from about 300 mμ to about 700 mμ when exposed to a light source rich in ultraviolet radiation. Suitable dyes include the flavins and thioflavins which have a bright yellow color and emit a high signal in the area of about 600 mμ and Rhodamine B which has a reddish color and emits a signal in the area of between 400 mμ and 500 mμ. Preferably, a combination of the yellow and red dyes is used in order to obtain the strong signal of the yellow dye and the coloration of the red dye which makes the formed images more easily readable by the naked eye.

The selection of suitable coating solvents will depend upon the particular ingredients present in the composition and such selection will be obvious to one skilled in the art. Generally, the solids content of the coating composition will be within the range of from about 13% to about 20%, most preferably between about 15% and 18%. Thus the volatile solvent content will range between about 80% and 87%.

While the proportions of the ingredients of the present compositions may be varied somewhat, depending upon the specific material used, the following table is illustrative of such proportions:

| Ingredient | % by Weight (solids) | % by Weight (total) |
|---|---|---|
| Resin binder | 20 to 30 | 2.6 to 6 |
| Hard Wax | 20 to 30 | 2.6 to 6 |
| Plasticizer | 30 to 45 | 4.3 to 9 |
| Dye(s) | 3 to 30 | 0.5 to 5 |
| Solvent(s) | — | 80 to 87 |

The following example illustrates the preparation of transfer elements according to one embodiment of the present invention:

| Ingredients | Parts by Weight |
|---|---|
| Vinyl chloride-vinyl acetate copolymer | 4.0 |
| Carnauba wax | 4.0 |
| Sorbitan monolaurate | 6.0 |
| Flavine Dye | 1.0 |
| Rhodamine B dye | 1.0 |
| Methyl ethyl ketone | 84.0 |

The vinyl resin is dissolved in the methyl ethyl ketone and a hot melt of the wax and plasticizer is slowly added thereto with stirring to cause a portion of the plasticized wax to be dissolved by the solvent. Thereafter, the dyes are added and dissolved and the composition is mixed in a ball mill for several hours.

The coated web may be provided with an opaque frangible supercoating such as a thin hot melt wax coating or wax emulsion coating containing a masking pigment such as titanium dioxide, mica, aluminum lamelliform particles, or the like, or containing an ultraviolet radiation-absorbing barrier material of the type conventionally used in tanning lotions to prevent the penetration of ultraviolet radiation. This adapts the transfer element for the application of fluorescing images to translucent copy sheets such as tissue paper or plastic film. The supercoating transfers with the dye layer to form an opaque underlayer beneath the dye images, which underlayer is impermeable to U. V. and prevents the dye images from being exposed to ultraviolet radiation when the opposite side of the sheet is exposed to such radiation, i.e., in cases where fluorescing images are present on both sides of a translucent copy sheet, it is necessary to prevent the images on the side opposite the side being sensed or read from fluorescing.

In either case, the coated web is cut into sheet lengths and widths or ribbon lengths and widths for the desired use.

Variations and modifications will be apparent to those skilled in the art within the scope of the appended claims.

We claim:

1. A pressure-sensitive transfer element adapted to transfer solid, fluorescing images to a copy sheet under the effect of imaging pressure, comprising a smooth, thin plastic film foundation supporting a volatile solvent-applied solid, complete-transfer imaging layer comprising from about 20% to 30% by weight of a synthetic thermoplastic resin binder material which is soluble in the application solvent, from about 20% to 30% by weight of a hard wax which is at least partially insoluble in the application solvent, the insoluble portion being present in the form of finely dispersed hard wax particles, from about 30% to 45% by weight of a non-volatile oily liquid plasticizer which is compatible with and softens said hard wax, and from about 3% to 30% by weight of a fluorescing dye in the form of a solid solution within said imaging layer, said dye being soluble in said application solvent, in said resin binder material and in said oily liquid plasticizer, said dye being capable of emitting intense radiation within the range of from about 300 mμ to about 700 mμ when exposed to a light source rich in infrared radiation.

2. A transfer element according to claim 1 in which the resin binder material comprises a vinyl chloride-vinyl acetate copolymer.

3. A transfer element according to claim 1 in which the hard wax comprises carnauba wax.

4. A transfer element according to claim 1 in which the oily liquid plasticizer comprises a sorbitan ester.

5. A transfer element according to claim 1 in which the fluorescing dye comprises a mixture of at least two such dyes having different colors and emitting radiation of different wave lengths within the range of from about 300 mμ to about 700 mμ when exposed to a light source rich in ultraviolet radiation.

6. A transfer element according to claim 1 in which said imaging layer is covered by a solid, complete-transfer supercoating which is impermeable to ultraviolet radiation.

* * * * *